US007582022B2

(12) United States Patent
Ochi

(10) Patent No.: US 7,582,022 B2
(45) Date of Patent: Sep. 1, 2009

(54) BOWLING GAME APPARATUS WITH PIN TOPPLING DEVICE AND BALL DETECTOR

(75) Inventor: Yasushi Ochi, Izumisano (JP)

(73) Assignee: BLD Oriental, Ltd., Izumisano-shi, Osaka (JP)

( * ) Notice: Subject to any disclaimer, the term of this patent is extended or adjusted under 35 U.S.C. 154(b) by 221 days.

(21) Appl. No.: 11/572,497

(22) PCT Filed: May 26, 2005

(86) PCT No.: PCT/JP2005/009646

§ 371 (c)(1),
(2), (4) Date: Jan. 23, 2007

(87) PCT Pub. No.: WO2006/011289

PCT Pub. Date: Feb. 2, 2006

(65) Prior Publication Data

US 2007/0287549 A1 Dec. 13, 2007

(30) Foreign Application Priority Data

Jul. 23, 2004 (JP) ..... 2004-215425

(51) Int. Cl.
*A63D 3/00* (2006.01)

(52) U.S. Cl. ..... 473/54; 473/64

(58) Field of Classification Search ..... 473/57, 473/64, 74–77, 85, 86, 101, 56, 67, 69
See application file for complete search history.

(56) References Cited

U.S. PATENT DOCUMENTS 2,572,456 A * 10/1951 Durant et al. ..... 273/126 A
2,966,561 A * 12/1960 Durant ..... 200/61.1
3,063,719 A * 11/1962 Rosenberger ..... 273/126 A
3,123,356 A * 3/1964 Moreland ..... 473/57
3,508,749 A * 4/1970 Murphy ..... 473/74
6,283,872 B1 9/2001 Lichodziejewski et al.

FOREIGN PATENT DOCUMENTS

WO WO 97/29817 A1 8/1997

OTHER PUBLICATIONS

European Search Report dated Nov. 27, 2007, issued in corresponding European Patent Application No. 05743776.

* cited by examiner

*Primary Examiner*—William M. Pierce
(74) *Attorney, Agent, or Firm*—Westerman, Hattori, Daniels & Adrian, LLP.

(57) ABSTRACT

Bowling game apparatus allowing even children of little strength to obtain high score by strikes and spares. The bowling game apparatus comprising an approach as an area where players roll a ball, a lane extending from the approach and on which the ball the players bowl rolls, a plurality of pins arranged and placed on the end of the lane and trough-like gutters is further provided with pin toppling means (20) for overturning several pins individually, bowling ball detectors (35) for detecting a ball rolling down the lane, controllers (41), (45) for timing the actuation of pin toppling means (20) to the collision of the ball with the pins on the basis of a detection signal from bowling ball detector (35) to overturn previous selection from the pins.

20 Claims, 9 Drawing Sheets

*Fig. 6*

| Handicap | Assisted frame count |
|---|---|
| 0 to 20 | 0 |
| 21 to 40 | 1 |
| 41 to 60 | 2 |
| 61 to 80 | 3 |
| 81 to 100 | 4 |
| 101 to 120 | 5 |
| 121 to 140 | 6 |
| 141 to 160 | 7 |
| 161 to 180 | 8 |

*Fig. 7*

Topple-assist pin data for 1st attempt

| Ball passing-point | Toppled pins |
|---|---|
| None | None |
| 35a | 4,5,6,7,8,9,10 |
| 35b | 2,3,4,5,6,7,8,9,10 |
| 35c | 2,3,4,5,6,7,8,9,10 |
| 35d | 1,2,3,4,5,6,7,8,9,10 |
| 35e | 1,2,3,4,5,6,7,8,9,10 |
| 35f | 1,2,3,4,5,6,7,8,9,10 |
| 35g | 2,3,4,5,6,7,8,9,10 |
| 35h | 2,3,4,5,6,7,8,9,10 |
| 35i | 4,5,6,7,8,9,10 |

Topple-assist pin data for 2nd attempt

| Ball passing-point | Remaining pin position | | |
|---|---|---|---|
| | 1 | 1,2,3 | Total pins remaining |
| None | None | None | None |
| 35a | None | None | 4,5,6,7,8,9,10 |
| 35b | None | 2,3 | 2,3,4,5,6,7,8,9,10 |
| 35c | None | 2,3 | 2,3,4,5,6,7,8,9,10 |
| 35d | 1 | 1,2,3 | 1,2,3,4,5,6,7,8,9,10 |
| 35e | 1 | 1,2,3 | 1,2,3,4,5,6,7,8,9,10 |
| 35f | 1 | 1,2,3 | 1,2,3,4,5,6,7,8,9,10 |
| 35g | None | 2,3 | 2,3,4,5,6,7,8,9,10 |
| 35h | None | 2,3 | 2,3,4,5,6,7,8,9,10 |
| 35i | None | None | 4,5,6,7,8,9,10 |

BOWLING GAME APPARATUS WITH PIN TOPPLING DEVICE AND BALL DETECTOR

TECHNICAL FIELD

The present invention relates to a bowling game apparatus in which for enjoyment a ball is rolled down a lane at the head of which a group of pins is arranged into place, and the pins are knocked down by the rolling ball.

BACKGROUND ART

Such bowling game apparatuses are configured with: an approach where players roll a ball; a lane extending from the approach and on which the ball rolls; a group of pins placed on the end of the lane opposite the approach; trough-like gutters lying on either side of the lane and receiving balls slipping off the lane. Players enjoy the game by competing with each other for a higher score that depends on the number of pins they knock down.

Of course, how many pins players are able to knock down depends on the direction of in which the ball is rolled—that is, which part of the arranged pins their balls strike—and collision energy generated by the collision of ball with the pins (the ball weight and speed) and the rotating state of the ball. In terms of only the direction of in which the ball is rolled, players' scores are determined by players' skill at controlling the ball toward the center of the lane.

Being not yet fully developed physically, children are able to manage only a light ball and poor at controlling the direction of the rolling ball, and consequently cannot hope for a high score, or as is likely to happen, they are able to knock down only a few pins because the ball always falls into the gutter. In such cases, children lose interest in the bowling game, and are left unable to enjoy household bowling outings with the object of interacting as a family.

In light of such considerations, various gutter-ball prevention apparatuses for preventing a bowled ball from falling into the gutter have been proposed to date. One of such apparatus is configured so that bars, which are placed along the both sides of the lane, simultaneously shift horizontally between a blocking position near the edge of the lane, where the bars prevent the ball from falling into the gutter, and a retract position near the edge of the gutters, where the bars shift from the blocking position. (Reference is made to Japanese Unexamined Pat. App. Pub. Nos. H7-155424, No. H9-84923 and No. H11-164931.)

In accordance with this gutter prevention apparatus, the bars shift into the blocking position when players, such as young children, unable to control a ball well bowl, and shift into the retract position when physically more developed adolescent players bowl.

Therefore, even if a ball rolled by juvenile players unable to control the direction of the rolling ball well rolls toward a gutter, the bars shift into the blocking position to prevent the ball from falling into the gutters and retain it on the lane, such that the ball runs into the pins and knocks down some of them as a result. In other words, even children are able to always knock down some of the pins and score.

The bars are shifted into the retract position when non-children players bowl, so that any gutter balls they bowl will fall directly into a gutter without being blocked.

The fact that this gutter prevention apparatus allows children to always knock down some of the pins and score encourages them to maintain interest in the game. Moreover, children are able to bowl along with adolescent and older players in the same lane, so that they are able to enjoy a household bowling outing to interact with as a family.

Additionally, the following apparatuses have been also proposed: an apparatus configured so that bars simultaneously shift vertically between a blocking position and a retract position lower than the blocking position (reference is made to Japanese Unexamined Pat. App. Pub. Nos. H10-151235 and 2002-65933), and an apparatus configured so that the gutters rotate toward the lane about axes paralleling the lane lengthwise (reference is made to Japanese Unexamined Pat. App. Pub. No. H10-506031). Both of these play the same role as that of the apparatus explained in the foregoing.

Patent Document 1: Japanese Unexamined Pat. App. Pub. No. H7-155424.

Patent Document 2: Japanese Unexamined Pat. App. Pub. No. H9-84923.

Patent Document 3: Japanese Unexamined Pat. App. Pub. No. H11-164931.

Patent Document 3: Japanese Unexamined Pat. App. Pub. No. H10-151235.

Patent Document 3: Japanese Unexamined Pat. App. Pub. No. 2002-65933.

Patent Document 3: Japanese Unexamined Pat. App. Pub. No. H10-506031.

DISCLOSURE OF INVENTION

Problem Invention is to Solve

Conventional bowling game apparatuses with gutter-ball prevention devices, however, are less than adequate to maintain children's interest in the bowling game.

For example, in the gutter prevention apparatus configured so that the bars shift into a blocking position, to the extent that strong rebounding power between the bars and the ball is not assured, even if a ball bowled by a player rolls toward a gutter and runs into one of the bars, the ball just rolls along the bar and strikes only a few pins positioned on the edge of the lane. Even if the apparatus were configured to provide considerable rebounding power between the bars and a ball, it would not guarantee that many pins would always be knocked down, because the ball would roll in various directions after running into the bars.

How many pins players are able to knock down depends on collision energy generated by the collision of a ball with the pins (the ball weight and collision speed) and the rotating state of the ball as well as the direction of in which the ball is rolled. Being of little strength, children cannot manage a heavy ball, which rolls at a low speed and low rpm, so that the number of pins that they can knock down is fewer than that non-children players can, even if children manage to roll a ball toward the center of the lane and the ball strikes the center of the pins. When children think they rolled a ball well, they experience a sense of satisfaction at rolling a ball well and have good hopes that many of pins will fall down, so that they are disappointed all the more for these good hopes when the actual number of pins turned over belies their hopes, the repetition of which may deprive children of interest in the bowling game consequently.

For this reason, the bowling game apparatus with this gutter prevention device is less than adequate for children who get bored easily, although compared with bowling facilities lacking the device, it has some advantage in helping maintain children's interest in a bowling game. In other words, to sustain the interest of children—who are curious, superiority-conscious and rich in a desire to improve themselves—in the game, there is a need for a situation in which they can get strikes and spares enough to raise their score to equal or better than the level of adolescent and older players, to let them compete at the same level as adolescent and older players.

The same holds true for the bowling game apparatus configured so that the gutters rotate toward the lane.

The present invention is made in view of the fact explained in the foregoing and for the purpose of providing a bowling game apparatus allowing children of little strength to get strikes and spares enough to get a high score.

Means for Resolving the Problem

The present invention for achieving the purpose involves a bowling game apparatus furnished with an approach where players roll a ball, a lane extending from the approach and on which the ball bowled by the players rolls, a plurality of pins arranged on the end of the lane opposite the approach, trough-like gutters lying on the both sides of the lane and receiving the ball slipping off the lane, and the bowling game apparatus having a configuration provided with a pin toppling means for turning the individual pins over, a ball detector for detecting the ball rolling down the lane and a controller for timing the actuation of the pin toppling means to the collision of the ball with the pins on the basis of a detection signal from the ball detector to turn over previous selections from the pins.

According to this bowling game apparatus, when players roll a ball, which rolls down the lane toward a group of pins, the ball detector detects the ball first. Then the controller recognizes when the ball collides with the pins on the basis of a detection signal from the detector to time the actuation of the pin toppling means to the collision of the ball with the pins, allowing the previously selected pins to fall down the lane.

In this way the bowling game apparatus makes it possible to time the toppling of the given pins to the collision of a ball with the pins, so that if children of little strength bowl, for example, turning all the pins over when the children manage to roll a ball toward the center of the lane allows them to get a strike, and turning over all the pins left upright after children first attempt when the ball they roll on their second attempt strikes any of the survived pins allows the children to get a spare. In other words, the operation of an assisting system configured with the ball detector, the pin toppling means and the controller enables even children of little strength to get a strike and a spare easily.

The bowling game apparatus involving in the present invention enables children to get a high score that favorably compares with non-children players even if they bowl all together on one lane, so that children are able to enjoy a household bowling game outing by competing with each other at the same level as non-children players without losing interest in the game.

When a ball collides with the pins is recognized by, for example, placing the ball detector in front of the pins viewed from the approach to detect the ball just before it collides with the pins.

The controller can be configured so as to determine which frames require the actuation of the pin toppling means through a game on the basis of handicaps determined depending on players' skill, and then to monitor the comings of the determined frames during the progress of the game to actuate the pin toppling means, which turns the given pins over.

Operating the assisting system whenever players roll a ball to allows them to get always a high score regardless of their skill may have the opposite effect to what is intended, resulting in their loss of interest in the game. Therefore, if the assist frames that requires the operation of the assisting system is determined on the basis of the handicaps that depend on players' skill to allow the assisting system to actuate only in the determined assist frames, players' real abilities are handicapped to make them apparently equal in their skill, allowing them to enjoy a so-called fight with real swords during the game.

In a bowling game, the score rises depending on how many times players get a strike consecutively and how many pins they knock down on their first attempt subsequent to the frame in which they get a spare, as well as on the total number of pins they knock down in each frame. Therefore, even if the players get a strike or a spare owing to the operation of the assisting system in an assist frame, their scores do not always rise depending on the results (strike, spare or open frame) prior to and subsequent to the assist frame. That is, even if the assisting system performs the assist, players' score has variability, which keeps a bowling game enjoyable to prevent the players from losing interest in the game.

Moreover, configuring the ball detector so as to detect a longitudinal and widthwise point of a ball on the lane allows the controller to determine the pins to be turned over on the basis of the widthwise ball position the ball detector detects to actuate the pin toppling means, which turns the determined pins over.

Usually, a total of ten pins are alternately arranged so as to create a triangle on a plane with four pins placed in the end row, three in the third row, two in the second row and one in the first row viewed from the approach. Therefore, some of the pins never fall down theoretically even if a ball strikes any part of a group of the pins. Operating the assisting system to turn these pins over too makes the game contrived, spoiling the game itself.

Thus turning over only the pins determined on the basis of the widthwise ball position the ball detector detects prevents a hint of contrivance from spoiling the game.

The pin toppling means can adopt various configurations, the first of which is provided with a pressurized-air supply source for supplying a pressurized air, nozzles placed one-to-one corresponding to the pins to directionally jet out a pressurized air supplied from the supply source at the corresponding pins and control valves for opening and shutting the path for the pressurized air flow supplied to the nozzles. In this configuration, the nozzles jet a pressurized air, which turns the corresponding pins over.

The second configuration is provided with rising/lowering units shiftably embedded up and down through the lane within the area where the pins are distributed to shift upward out and downward to the same level of or below the top surface of the lane, and a drive means on which the rising/lowering units shift up and down. In this configuration, these units shift up and down to turn the pins over.

The third configuration is provided with permanent magnets provided in the underside of the pins, electric magnets embedded under or below the lane within the area where the pins are distributed and an electric power supplier for the electric magnets. In this configuration, opposed sides of the permanent and electric magnets are of opposite polarity, so that electrification polarizes the electric magnets to tip the pins over.

The fourth configuration is provided with vibration-generating mechanisms embedded in the lane within the area where the pins are distributed. In such a configuration, the pins are placed on the vibration-generating mechanisms, which vibrate to upset the pins.

Additionally, providing the bowling game apparatus with a sound effect generator for outputting sound effect of pins colliding with each other to fall down enables a configuration in which the controller actuates the pin toppling means to turn the pins over simultaneously with actuating the sound effect generator to output the sound effect.

In this configuration, the noise of collision and overturning of the pins sounds when the pin toppling means operates to overturn the pins, making the collision and toppling of the pins much closer to reality.

EFFECTS OF THE INVENTION

According to the present invention provided with the configuration explained in the foregoing, children are able to get a high score that favorably compares with non-children players even if they bowl all together on one lane, so that children are able to enjoy a household bowling game outing by competing with each other as players at the same level with non-children players without losing interest in the game.

BRIEF DESCRIPTION OF DRAWINGS

FIG. 6 is a data table stored in an operational data storage unit involving the present embodiment, wherein the data table defines correlations between handicap and the assisted frame count.

FIG. 7 is a data table stored in an operational data storage unit involving the present embodiment, wherein the data table defines correlations between a ball sensor having detected a ball, and which number pins are to be overturned by the assist on a player's first attempt.

LEGEND

1: bowling game apparatus;
2: approach;
3: lane;
4: gutter;
5: bowling pins;
20: topple-assist mechanism;
22: nozzles;
23: control valve;
25: compressed-air supply source;
35: bowling ball sensor;
36: sound effect output unit;
40: controller;
41: machine controller;
45: aid-executing processor;
46: player data storage;
47: operational data storage unit.

BEST MODE FOR CARRYING OUT THE INVENTION

Figure 1:
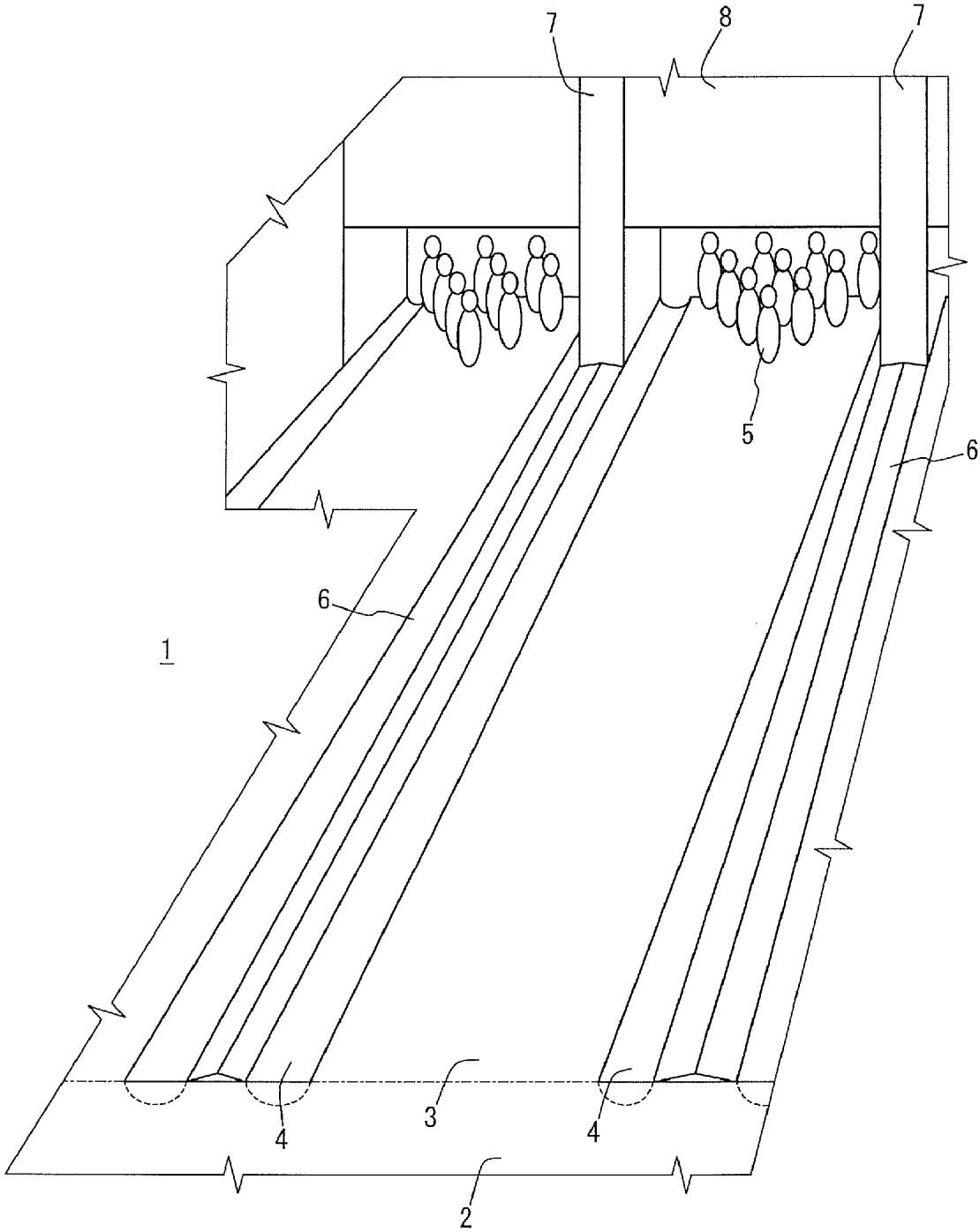
FIG. 1 is a perspective view presenting a configurational outline of a bowling game apparatus in accordance with a first embodiment of the present invention.
Figure 2:
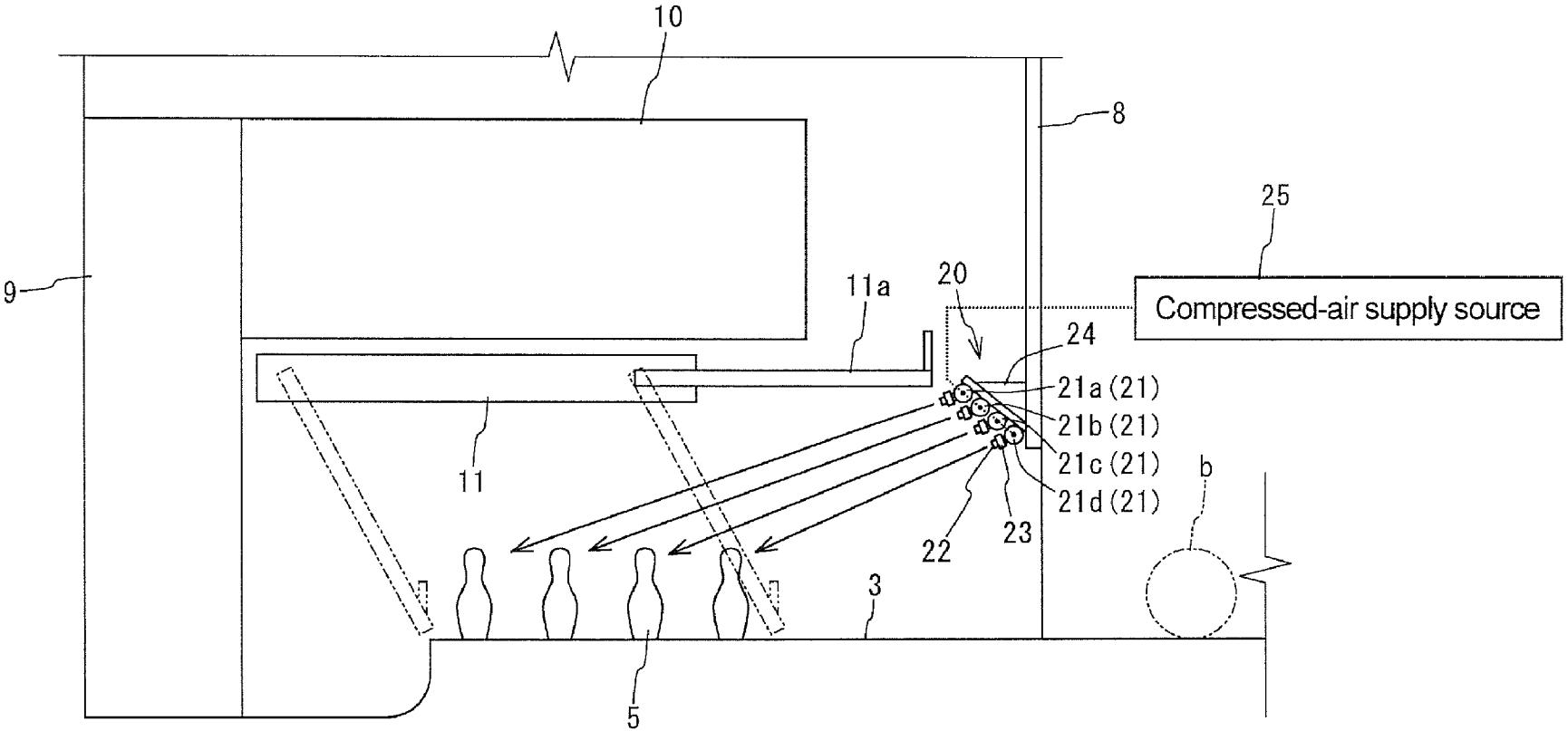
FIG. 2 is a lateral section view of the bowling game apparatus represented in FIG. 1.
Figure 3:
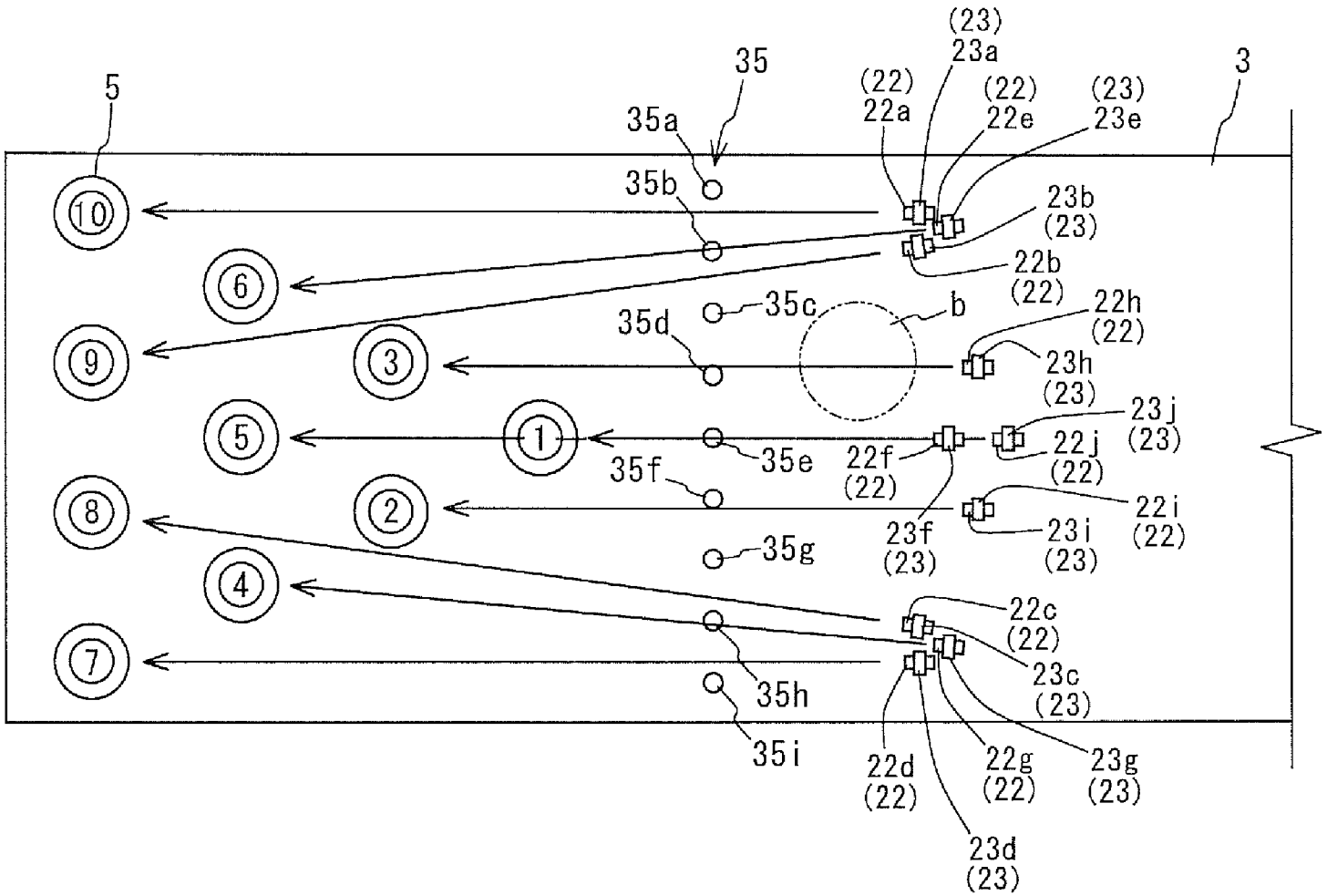
FIG. 3 is a plan view of the bowling game apparatus represented in FIG. 1.
Figure 4:
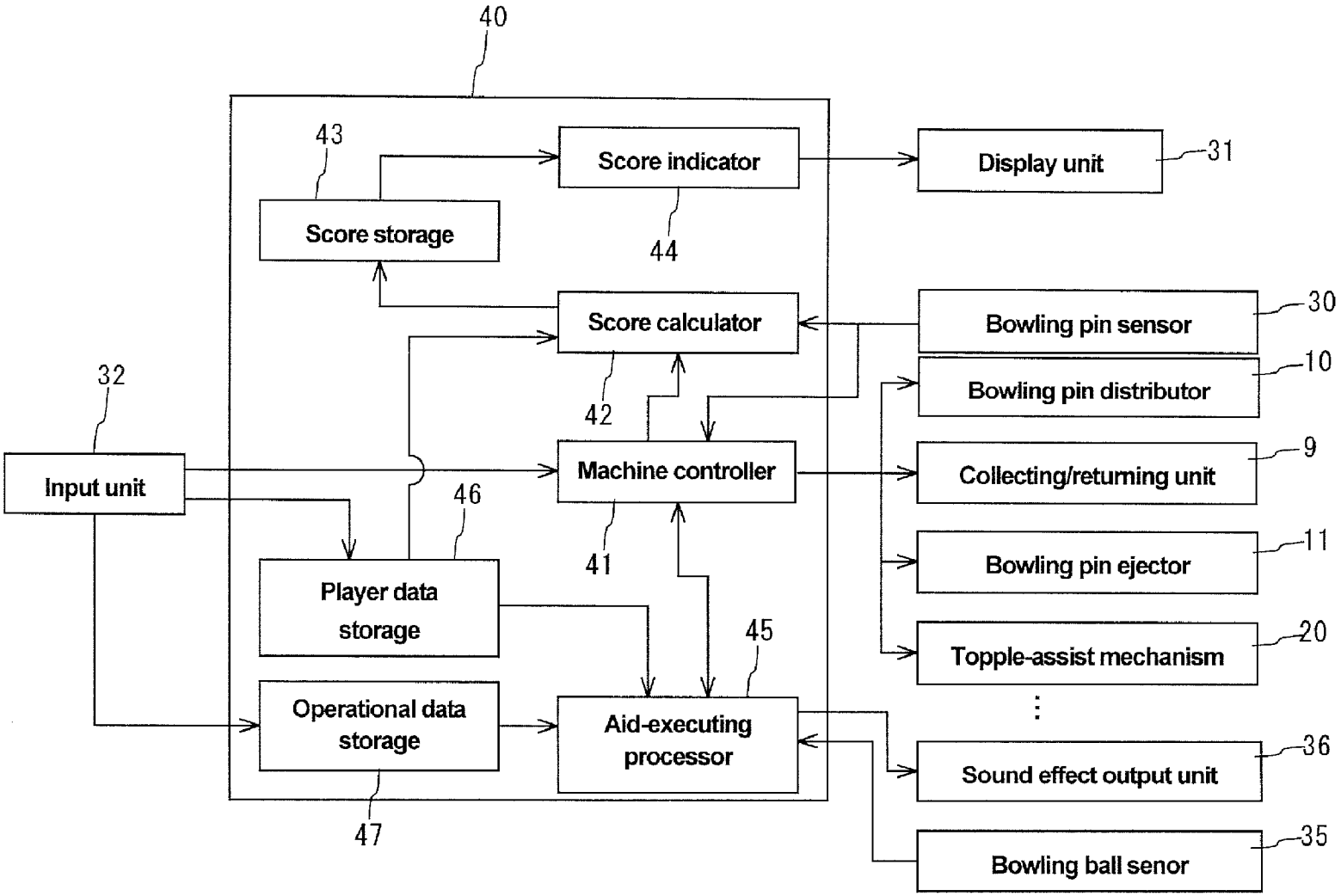
FIG. 4 is a block diagram presenting a configurational outline, in which a control system is incorporated, of the bowling game apparatus in accordance with the present embodiment.

A specific embodiment of the present invention is explained hereinafter with reference to the accompanying drawings. FIG. 1 shows a perspective view, FIG. 2 shows a sectional side view and FIG. 3 shows a plan view of the configuration outline of a bowling game apparatus involving in the embodiment. And FIG. 4 shows a block diagram of the configuration outline including a control system of the bowling game apparatus involving in the embodiment.

As illustrated in FIG. 1, bowling game apparatus 1 of this embodiment comprises basically approach 2 as an area where players roll bowling ball b down, lane 3 extending form approach 2 and on which ball b rolls, ten bowling pins 5 arranged on the end of lane 3 opposite approach 2 and trough-like gutters 4, 4 provided paralleling both sides of lane 3, and bowling game apparatus 1 is configured with adjacently placed plural sets of them.

Separator 6, which is provided between adjacent gutters 4, 4, separates play zones configured with lane 3 and gutters 4, 4. Partition wall 7, which is provided between adjacent gutters 4, 4 near where pins 5 are placed, also separates the play zones. Front-cover 8 is provided over lane 3 between walls 7, 7 and pins 5 are placed on the lane 3 in the space partitioned by front-cover 8 and walls 7, 7.

As illustrated in FIG. 2, bowling pin distributor 10 and bowling pin ejector 11 are provided in each area partitioned by walls 7, 7 and front-cover 8, on the backside of which topple-assist mechanism 20 is installed to couple with compressed-air supply source 25. A bowling pin toppling device of this embodiment is configured with compressed-air supply source 25 and topple-assist mechanism 20. Besides, lane 3 extends to where collecting/returning unit 9 is disposed to collect ball b that comes rolling down lane 3 or gutter 4 and pins 5 ejected from lane 3 and to return them to approach 2 and pin distributor 10 respectively. As illustrated in FIG. 4, controller 40 controls pin distributor 10, pin ejector 11, topple-assist mechanism 20 and collecting/returning unit 9.

Pin distributor 10 moves up and down to place pins 5 upright on lane 3 and pin ejector 11 is provided with ejecting arm 11*a*, which pivots downward (the position shown by the first two-dot chain line in FIG. 2) from a front horizontal start position (shown by the solid line in FIG. 2) before horizontally shifting backward (into the position shown by the second two-dot chain line), and then backtracks into the start position, so that this operations of arm 11*a* allows pin ejector 11 to eject pins 5 left from lane 3 or gutter 4 toward collecting/returning unit 9.

Pin distributor 10 and pin ejector 11 are controlled by machine controller 41 comprised of controller 40 to operate in synchronization with each other.

Specifically, with 10 pins 5 placed upright on lane 3, players roll a ball on their first attempt and the ball reaches collecting/returning unit 9, when ejecting arm 11*a* first pivots downward before pin distributor 10 moves down to grasp pins 5 left upright on lane 3, and then moves up with pins 5 grasped.

As illustrated in FIG. 4, pin distributor 10 is provided with pin sensor 30, which detects the presence or absence of pins that pin distributor 10 grasps and also detects what number pins are grasped when their presence is detected.

Second, if the presence of pins 5 pin distributor 10 grasps is detected, ejecting arm 11*a* horizontally shifts backward to eject pins 5 left turned over from lane 3 and gutter 4 toward collecting/returning unit 9 before backtracking horizontally, and then pin distributor 10 moves down to place grasped pins 5 upright on lane 3 before moving up simultaneously with upward pivoting of arm 11*a*, completing the first pin distribution after a player's first attempt.

After the first pin distribution, players roll a ball on their second attempt and the ball reaches collecting/returning unit 9, when arm 11*a* pivots downward, and then shifts backward likewise to eject all the pins from lane 3 and gutter 4 before backtracking horizontally, and then pin distributor 10 moves down to place 10 pins 5 on lane 3 before moving up simultaneously with upward pivoting of arm 11*a*, completing the second pin distribution after a player's second attempt (before his or her first attempt).

On the other hand, if the absence of pins grasped by pin distributor 10 is detected—that is, if players get a strike, arm 11*a* horizontally shifts backward to eject pins 5 left knocked down from lane 3 and gutter 4 toward collecting/returning unit 9 before backtracking horizontally, and then pin distributor 10 moves down to place ten pins 5 on lane 3 before moving up simultaneously with upward pivoting of arm 11*a*, completing the pin distribution.

As illustrated in FIG. 2 and FIG. 3, topple-assist mechanism 20 is provided with mounting bracket 24 fixed on the backside of front cover 8, four supply pipes 21 (21*a*, 21*b*, 21*c*, 21*d*) coupled to compressed-air supply source 25 and fixed to bracket 24 so as to parallel each other and intersect with the longitudinal direction of lane 3, nozzles 22 (22*a*, 22*b* . . . 22*i*, 22*j*) fixed to supply pipes 21 one-to-one corresponding to pins 5 to directionally jet out compressed air fed by compressed-air supply source 25 at corresponding pins 5 and control valves 23 (23*a*, 23*b* . . . 23*i*, 23*j*) provided along paths for compressed-air flow supplied to each nozzle to open and shut the path.

As illustrated in FIG. 3, in this embodiment, nozzles 22*a*, 22*b*, 22*c*, 22*d*, 22*e*, 22*f*, 22*g*, 22*h*, 22*i*, 22*j* are disposed directionally at the pins number 10, 9, 8, 7, 6, 5, 4, 3, 2 and 1 respectively to jet out compressed air, which strikes the head of pins 5, which is turned over.

Besides, nozzles 22*a*, 22*b*, 22*c* and 22*d* are fixed on supply pipe 21*a*, nozzles 22*e*, 22*f* and 22*g* are on pipe 21*b*, nozzles 22*h* and 22*i* are on pipe 21*c* and nozzle 22*j* are on pipe 21*d*.

Control valve 23 actuates under the control of machine controller 41 to open, allowing nozzles 22 to jet a compressed air flow, which strikes the heads of corresponding pins 5, which is turned over.

As illustrated in FIG. 4, controller 40 is provided with score calculator 42, score storage 43, score indicator 44, aid-executing processor 45, player data storage 46 and operational data storage unit 47 as well as machine controller 41.

Player data storage 46 is a functional part for storing players' data input from external input unit 32, such as name, sex, age, handicap and personal data of and the bowling order of players who bowl on the given lane.

Score calculator 42 reads out players' data from player data storage 46 to recognize their personal data and bowling order, receives control data from machine controller 41 to recognize progress of the game, receives data on pins 5 each player knock down to calculate individual scores, and stores data on the calculated scores and the players' data in score storage 43.

Score indicator 44 reads out the players' individual scores and personal data stored in score storage 43 to indicate them on display unit 31 such as screen. Display unit 31 is installed in the location where players can see the indication from an area as waiting position for players near approach 2 (for example, the location over the waiting position) so that players check the indication on display unit 31 to know the progress of the game and their scores.

Figure 5:
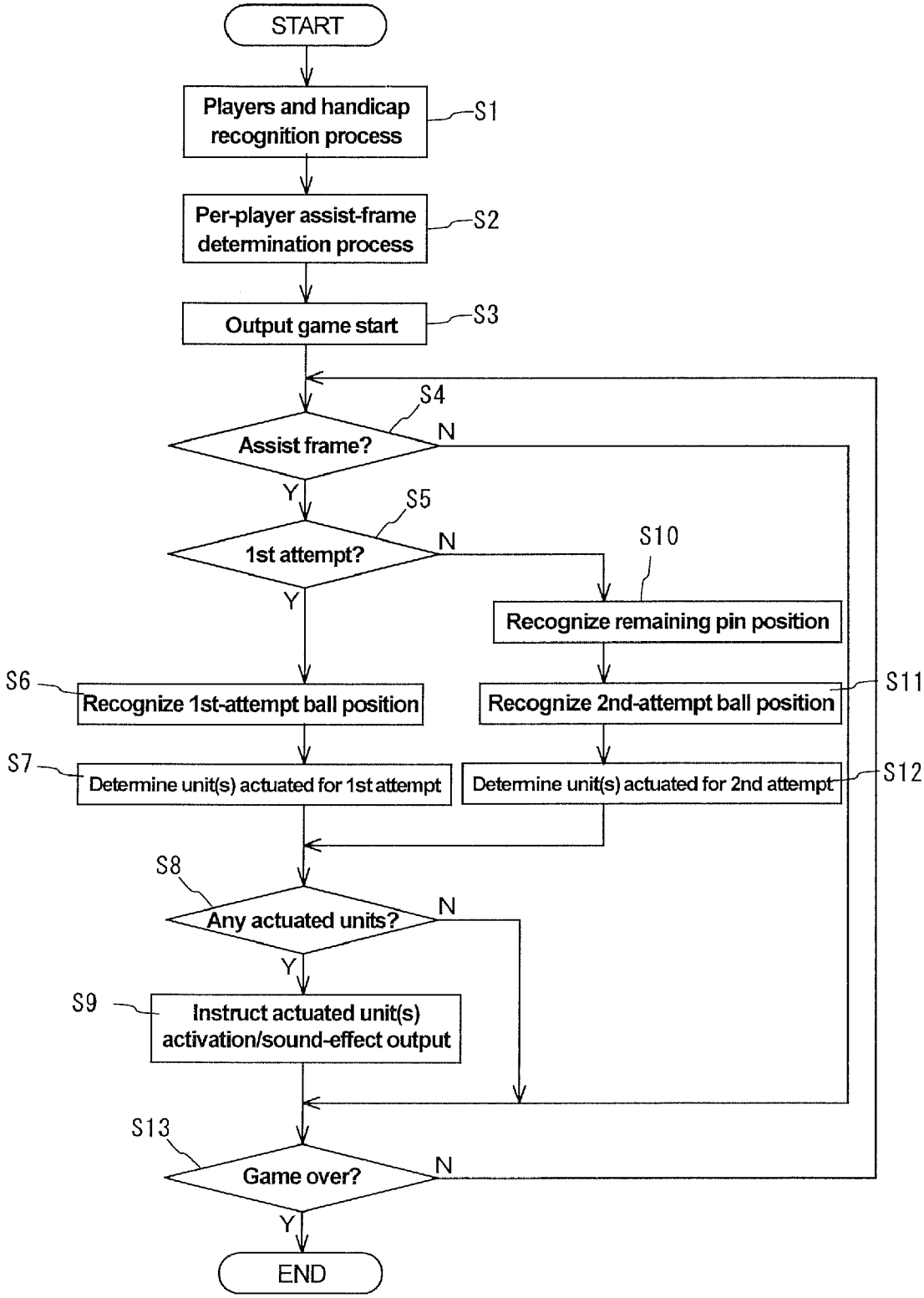
FIG. 5 is a flowchart of processing procedures in an aid-executing processor in accordance with the present embodiment.

Aid-executing processor 45 recognizes players' handicaps stored in player data storage 46 to determine assist frames which require the actuation of topple-assist mechanism 20 during the game on the basis of the recognized players' handicaps, and then monitors the progress of the game to time the actuation of topple-assist mechanism 20 to the comings of the assist frames, executing the processing for tipping the given pins 5 over—that is, aid-executing processor 45 performs the assist processing to turn pins 5 over. Specifically, the processing shown in FIG. 5 is executed.

More specifically, first, each player's handicap and bowling order in player data storage 46 is recognized (step S1), and then the recognized handicap is compared with the data table in operational data storage unit 47 as illustrated FIG. 6 defining the correlation between the handicap and the number of assist frames to obtain the assist frames number, on the basis of which the assist frames are determined for each player (step S2).

The data table in FIG. 6 is entered from input unit 32 and previously stored in operational data storage unit 47. To determine the assist frames, for example, if several patterns of the combination of assist frames are predetermined on the basis of the number of assist frames, one combination pattern can be randomly selected or a random number also can be used.

Next, aid-executing processor 45 sends a signal instructing machine controller 41 to start a bowling game (step S3), allowing players to start the game. Afterward, aid-executing processor 45 monitors the progress of the game on the basis of both the control data, which is received any time from machine controller 41, and the data on bowling order in player data storage 46 to recognize the comings of the assist frames determined in Step S2 for each player (step S4). Aid-executing processor 45 recognizes whether or not the players roll a ball on their first attempt when the assist frames come (step S5), and recognizes the rolled ball position on the basis of a detection signal from ball sensor 35 when players roll a all on their first attempt (step S6).

Bowling ball sensor 35 comprises a position detecting sensor like proximity switch. As illustrated in FIG. 3, a plurality of ball sensors 35 (35*a*, 35*b* . . . 35*h*, 35*i*) are embedded in appropriate positions paralleling widthwise direction of lane 3 in front of pins 5 viewed from approach 2, so that aid-executing processor 45 to recognize the widthwise passing point of ball b on lane 3 on the basis of a detection signal from a plurality of ball sensors (35*a*, 35*b* . . . 35*h*, 35*i*).

Next, aid-executing processor 45 compares the widthwise passing point of ball b on lane 3—that is, which sensor (35*a*, 35*b* . . . 35*h*, 35*i*) detects ball b with the data table in operational data storage unit 47 as shown in FIG. 7 to determine which of pins 5 is turned over, and recognizes control valves 23 supplying compressed air to nozzles 22 disposed to turn over determined pins 5 (step S7).

The data table in FIG. 7, which shows the correlation between which ball sensor (35*a*, 35*b* . . . 35*h*, 35*i*) detects ball b and what number pins are tipped over by the assist, is entered from input unit 32 and stored in operational data storage unit 47. In this data table, all the pins possible to fall down are selected from pins 5 except for theoretically impossible ones.

And then, if control valves 23 to be actuated are recognized, aid-executing processor 45 sends an operational control signal instructing machine controller 41 to actuate control valves 23, which opens to turn corresponding pins 5 over, and simultaneously actuates sound effect output unit 36 to output sound effect of pins 5 colliding with each other to fall down. (step S8 and S9) Valves 23 and sound effect output unit 36 are actuated simultaneously with the collision of ball b with pins 5.

When recognizing that players roll a ball on their second attempt in Step S5, aid-executing processor 45 receives a detection signal from pin sensor 30 via machine controller 41 to recognize what number pins are left upright on lane 3 (step S10).

Next, aid-executing processor 45 recognizes the widthwise passing point of ball b players rolled down lane 3 on their second attempt—that is, which ball sensor (35*a*, 35*b* . . . 35*h*, 35*i*) detects ball b (step S11) as in Step S6.

Figures 8, 9:
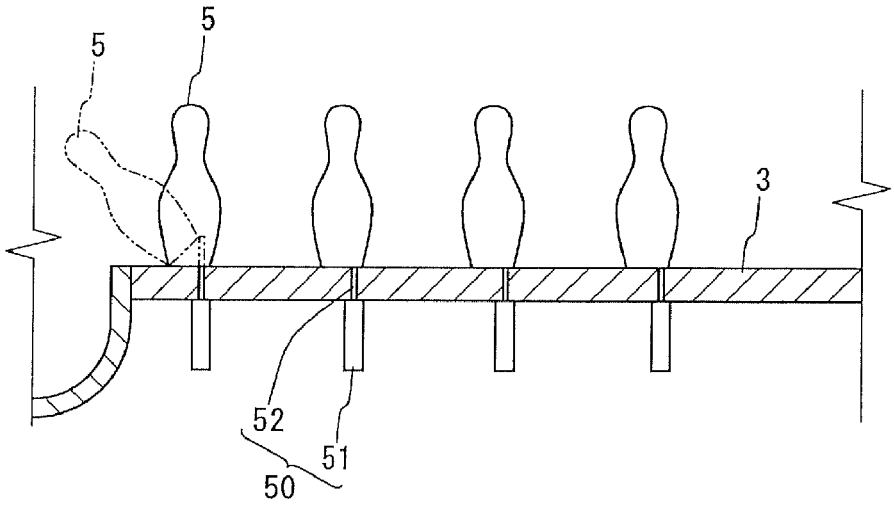
FIG. 8 is a data table stored in an operational data storage unit involving the present embodiment, wherein the data table defines correlations between a ball sensor having detected a ball, which number pins are to be overturned by the assist on a player's second attempt.
FIG. 9 is a lateral section view of a topple-assist mechanism in accordance with another embodiment of the present invention.

And then, aid-executing processor 45 compares the recognized ball sensor with the data table stored in operational data storage unit 47 as shown in FIG. 8 to determine pins 5 to be turned over, and then recognizes control valves 23 for supplying compressed air to nozzles 22 disposed to turn determined pins 5 over (step S12).

Data table in FIG. 8, which shows the correlation between which ball sensor (35*a*, 35*b* . . . 35*h*, 35*i*) detects ball b and what number pins are selected to be tipped over from the pins left upright after players' first attempt, is entered from input unit 32 and stored in operational data storage unit 47. In this data table, all the pins possible to fall down are selected except for theoretically impossible ones.

Next, aid-executing processor 45 sequentially executes Step S8 and Step S9, in which when recognizing control valves 23 to be actuated, aid-executing processor 45 sends an operational control signal instructing machine controller 41 to actuate control valves 23, which open to turn corresponding pins 5 over, and simultaneously actuates sound effect output unit 36 to output sound effect of pins colliding with each other to fall down.

After completing Step S9, aid-executing processor 45 recognize whether or not the game is over on the basis of control data from machine controller 41, and repeats the processing in step S4 to step S12 when the game is not over and completes this series of processing when the game is over (step S13).

In this way, aid-executing processor 45 determines assist frames on the basis of players' handicaps, and actuates topple-assist mechanism 20 in the determined assist frames depending on the position of ball b players roll, allowing topple-assist mechanism 20 to perform the assist for tuning over pins 5 as many as possible.

According to bowling game apparatus 1 configured as explained in the forgoing, aid-executing processor 45 determines assist frames for each player on the basis of players' handicaps entered from input unit 32 and stored in player data storage 46, allowing players to start a bowling game.

Subsequently, aid-executing processor 45 monitors the progress of the game for each player to distinguish whether or not the player is going to roll a ball in the assist frames, and then actuates topple-assist mechanism 20 depending on the position of ball b the player rolls down to allow topple-assist mechanism 20 to perform the assist, turning over pins 5 as many as possible.

Bowling game apparatus 1 actuates topple-assist mechanism 20 depending on the position of ball B players roll down to allow it to perform the assist, turning over pins 5 as many as possible, so that even when children of little strength bowl, turning all pins 5 over as long as they manage to roll ball b down toward the center of lane 3 enables them to get a strike, and turning over all pins 5 left upright after their first attempt when ball b children rolls on their second attempt strikes any of survived pins 5 allows them to get a spare.

How many pins 5 players are able to knocked down depends on the collision energy generated by the collision of ball b with pins 5 and its rotating state as well as the direction of in which ball b is rolled. Being of little strength, however, children are unable to manage heavy ball b, which rolls at a low speed and a low rpm, so that the number of pins that they can knock down is fewer than that non-children players can, even if children manage to roll ball b toward the center of lane 3 and ball b strikes the center of pins 5. When children think they rolled a ball well, they experience a sense of satisfaction at rolling a ball well and have good hopes that many of pins will fall down, so that they are disappointed all the more for these good hopes when the actual number of pins turned over belies their hopes, the repetition of which may deprive children of interest in the bowling game consequently.

According to bowling game apparatus 1, even children of little strength are able to get strikes and spares to get a high score that favorably compares with non-children players even if they bowl all together on one lane, so that children are able to enjoy a household bowling game outing by competing with each other as players at the same level as non-children players without losing interest in the game.

The frames in which knocking assist 20 operates is determined on the basis of handicaps determined depending on players' skill and topple-assist mechanism 20 operates only in the determined frames, so that players' real ability is handicapped to make the players apparently equal in their skill, allowing them to enjoy a so-called fight with real swords during the game.

In a bowling game, the score rises depending on how many times players get a strike consecutively and how many pins they knock down on their first attempt subsequent to the frame in which they get a spare, as well as on the total number of pins they knock down in each frame. Therefore, even if the players get a strike or a spare owing to topple-assist mechanism 20 in an assist frame, their scores do not always rise depending on the results (strike, spare or open frame) prior to and subsequent to the assist frame. That is, even if the topple-assist mechanism 20 performs the assist, players' score has variability, which keeps a bowling game enjoyable to prevent the players from losing interest in the game.

Some of pins 5 are theoretically impossible to tip over depending on the position of ball b, so that they are excluded from pins 5 to be turned over by the assist operation of topple-assist mechanism 20—that is, they are not turned over—to prevent a hint of contrivance from spoiling the game.

Additionally, outputting sound effect of pins 5 colliding with each other to fall down is timed to actuating topple-assist mechanism 20 to turn over pins 5, so that this sound effect makes the collision and toppling of pins 5 much closer to reality even when ball b knocks down only a few of pins 5—that is, when many of pins 5 are turned over by the operation of topple-assist mechanism 20 and only a few actually collide with each other.

While one embodiment of the present invention has been explained in the foregoing, specific modes by which the present invention can be adopted is not limited to it in any way.

For example, as illustrated in FIG. 9, the bowling pin toppling device comprising topple-assist mechanism 20 and compressed-air supply source 25 can have a configuration provided with topple-assist mechanism 50 comprising oil or air pressure cylinder 51 and rising/lowering rod 25 coupled to the piston rod of cylinder 51.

Rising/lowering rod 52 is shiftably provided up and down through lane 3 within the area where pins 5 are distributed to shift upward out downward to the same level of or below the top surface of lane 3. Cylinder 51 is supplied with pressure oil or pressured oil appropriately by the pressure oil or air pressure supply source.

According to topple-assist mechanism 50, rising/lowering rod 52 rises to turn pins 5 over.

Figure 10:
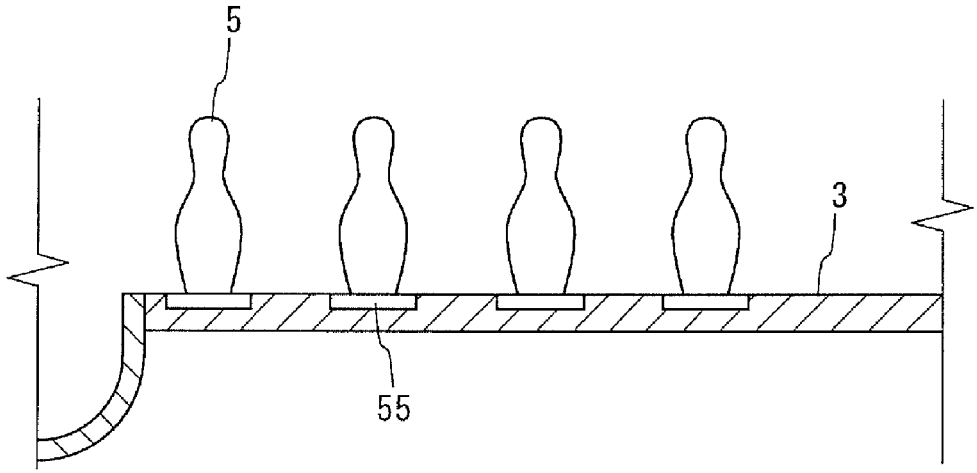
FIG. 10 is a lateral section view of a topple-assist mechanism in accordance with another embodiment of the present invention.
Figure 11:
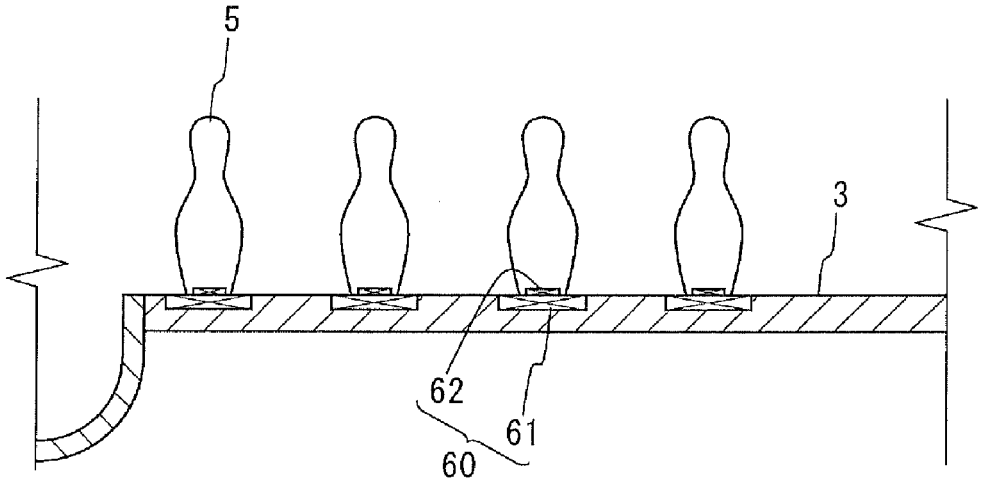
FIG. 11 is a lateral section view of a topple-assist mechanism in accordance with another embodiment of the present invention.

In addition, the pin toppling device can have other configurations, the first of which is provided with vibrator 55 as illustrated FIG. 10. Vibrator 55 is embedded in lane 3 within the area where pins 5 are distributed so that pins 5 are placed on vibrator 55. In this configuration, vibrator 55 vibrates to upset pins 5.

The second configuration is provided with topple-assist mechanism 60 comprising permanent magnets 62 embedded in the under side of pins 5 and electric magnets 61 embedded in lane 3 within the area where pins 5 are distributed. In this configuration, opposed sides of permanent magnets 62 and electric magnets 61 are the same polarity, so that electrification polarizes electric magnets 61 to turn pins 5 over.

Figure 12:
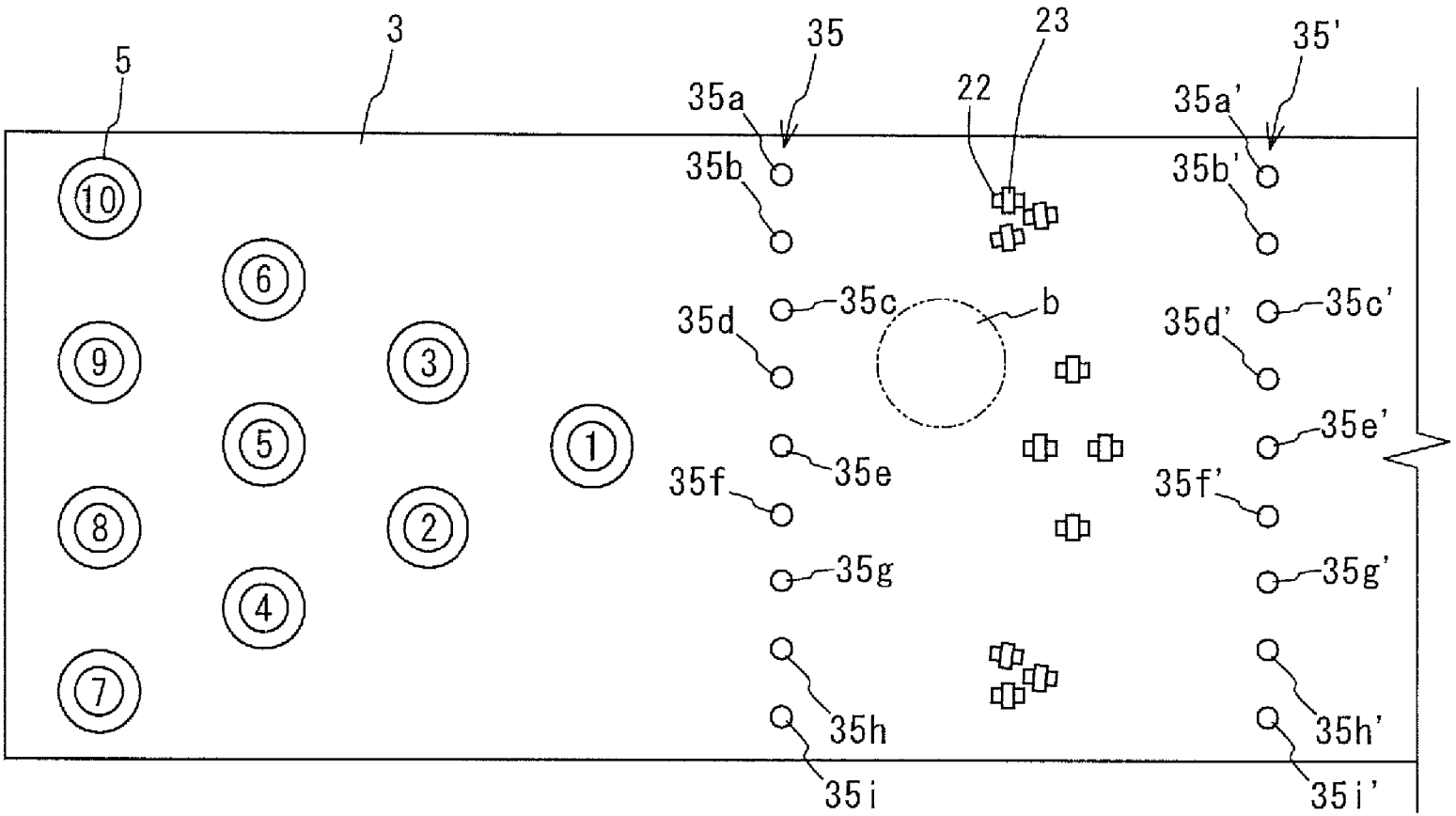
FIG. 12 is a plan view illustrating a bowling apparatus involving another embodiment of the present invention.

Moreover, any sensor will do as ball sensor 35 as long as it detect a longitudinal and widthwise point of ball b on lane 3, and its arrangement is not limited to the example illustrated in FIG. 3. For example, as illustrated in FIG. 12, sensor 35 can be configured so that a first row of sensor 35 is disposed in front of pins 5 viewed form approach 2 and a second row (35*a*', 35*b*' . . . 35*h*', 35*i*') and (or more rows) is spaced from the first row and pins 5.

In this case, ball sensors in each row detects a widthwise point of and a difference between times sensors in each row take for the detection of ball b on lane 3, so that aid-executing processor 45 can be configured so as to recognize the rolling direction and velocity of ball b on the basis on these detection results, and then determines pins 5 to be turned over by the assist on the basis of the recognized the widthwise position, the rolling direction and velocity of ball b.

Even if a ball passes through the same point on lane 3, which part of pins 5 the ball strikes varies depending on the direction of in which the ball passes through the point, so that which of pins 5 is knocked down varies. In the example illustrated in FIG. 3, the widthwise point of ball b can be detected but the direction in which ball b rolls and its rolling velocity cannot. Therefore, determining pins 5 to be turned over by the assist on the basis of only the widthwise point of ball b may make the game contrived depending on the direction in which ball b rolls and its rolling velocity.

Thus, determining pins 5 to be knocked down by the assist depending on the widthwise point, rolling direction and velocity of ball b eliminates any hint of contrivance, making the game closer to reality.

As explained in the foregoing, the present invention can be adopted preferably to a bowling game apparatus for a more enjoyable game in which players roll a ball down a lane on which a group of pins are arranged and try to knock down as many of pins as possible.

The invention claimed is:

1. A bowling game apparatus utilizing a bowling ball, comprising:

an approach area where a player carries out bowling actions;

a lane extending from said approach area and on which the bowling ball bowled by the player rolls;

a plurality of pins arranged and placed on an end of said lane opposite said approach area;

a pin toppling means for toppling each of said plurality of pins individually;

a ball detecting means for detecting the bowling ball rolling down said lane; and a control means for actuating said pin toppling means on the basis of a detection signal from said ball detecting means, said actuating being timed to collision of the bowling ball with said plurality of pins, to topple preestablished pins among said plurality of pins, wherein said control means comprises:

a first processing section for determining, on the basis of handicaps established in accordance with the player's skill level, in which frames of a game to actuate said pin toppling means; and a second processing section for monitoring the progress of the game and actuating said pin toppling means when the game reaches the frames determined by said first processing section.

2. The bowling game apparatus of claim 1, wherein said pin toppling means comprises:

a pressurized air supply source for supplying pressurized air, nozzles arranged in a one-to-one correspondence with said plurality of pins to impart directionality to the pressurized air supplied from said air supply source toward the corresponding pins, and to jet the pressurized air at the corresponding pins, and control valves for opening and shutting a flowpath for the pressurized air supplied to said nozzles;

wherein said plurality of pins are toppled by the pressurized air jetted from said nozzles.

3. The bowling game apparatus of claim 2, further comprising a sound-effect generating means for outputting a sound effect mimicking the sound of pins colliding with each other and overturning;

wherein said second processing section of said control means is configured to actuate said sound-effect generating means to output the sound effect when said pin toppling means is actuated to topple said plurality of pins.

4. The bowling game apparatus of claim 1, said pin toppling means comprises:

rise/lower members vertically shiftably embedded in lane within areas on said lane where said plurality of pins are placed, said rise/lower members including rise/lower member upper ends projecting upward from a surface of said lane when said rise/lower members have been shifted upward, and said rise/lower member upper ends being positioned slightly below a plane flush with the surface of said lane when said rise/lower members have been shifted downward; and a drive unit for shifting said rise/lower members up and down;

wherein said plurality of pins are toppled by said rise/lower members being shifted upward.

5. The bowling game apparatus of claim 4, further comprising a sound-effect generating means for outputting a sound effect mimicking the sound of pins colliding with each other and overturning;

wherein said second processing section of said control means is configured to actuate said sound-effect generating means to output the sound effect when said pin toppling means is actuated to topple said plurality of pins.

6. The bowling game apparatus of claim 1, wherein said pin toppling means comprises:

permanent magnets provided on undersides of said plurality of pins;

electromagnets embedded in, or arranged beneath, said lane within areas on said lane where said plurality of pins are placed; and an electric power supply device for supplying power to said electromagnets;

wherein polarities of mutually opposing sides of said permanent magnets and said electromagnets of the same polarity; and wherein said plurality of pins are toppled by supplying power to and thereby magnetizing said electromagnets.

7. The bowling game apparatus of claim 6, further comprising a sound-effect generating means for outputting a sound effect mimicking the sound of pins colliding with each other and overturning;

wherein said second processing section of said control means is configured to actuate said sound-effect generating means to output the sound effect when said pin toppling means is actuated to topple said plurality of pins.

8. The bowling game apparatus of claim 1, wherein said pin toppling means comprises vibration-generating mechanisms embedded in said lane within areas on said lane where said plurality of pins are placed;

wherein said plurality of pins are set onto said vibration-generating mechanisms, and said plurality of pins are toppled by vibration-generating mechanisms vibrating.

9. The bowling game apparatus of claim 8, further comprising a sound-effect generating means for outputting a sound effect mimicking the sound of pins colliding with each other and overturning;

wherein said second processing section of said control means is configured to actuate said sound-effect generating means to output the sound effect when said pin toppling means is actuated to topple said plurality of pins.

10. The bowling game apparatus of claim 1, further comprising a sound-effect generating means for outputting a sound effect mimicking the sound of pins colliding with each other and overturning;

wherein said second processing section of said control means is configured to actuate said sound-effect generating means to output the sound effect when said pin toppling means is actuated to topple said plurality of pins.

11. A bowling game apparatus utilizing a bowling ball, comprising:

an approach area where a player carries out bowling actions;

a lane extending from said approach area and on which the bowling ball bowled by the player rolls;

a plurality of pins arranged and placed on an end of said lane opposite said approach area;

a pin toppling means for toppling each of said plurality of pins individually;

a ball detecting means for detecting the bowling ball rolling down said lane; and a control means for actuating said pin toppling means on the basis of a detection signal from said ball detecting means, said actuating being timed to collision of the bowling ball with said plurality of pins, to topple preestablished pins among said plurality of pins, wherein said ball detecting means is configured to detect the ball's longitudinal and widthwise position on said lane, wherein said control means comprises:

a first processing section for determining, on the basis of the widthwise position of the ball as detected by said ball detecting means, which pins to topple, and a second processing section for actuating said pin toppling means to topple the pins determined by said first processing section.

12. The bowling game apparatus of claim 11, wherein said pin toppling means comprises:

a pressurized air supply source for supplying pressurized air, nozzles arranged in a one-to-one correspondence with said plurality of pins to impart directionality to the pressurized air supplied from said air supply source toward the corresponding pins, and to jet the pressurized air at the corresponding pins, and control valves for opening and shutting a flowpath for the pressurized air supplied to said nozzles;

wherein said plurality of pins are toppled by the pressurized air jetted from said nozzles.

13. The bowling game apparatus of claim 12, further comprising a sound-effect generating means for outputting a sound effect mimicking the sound of pins colliding with each other and overturning;

wherein said second processing section of said control means is configured to actuate said sound-effect generating means to output the sound effect when said pin toppling means is actuated to topple said plurality of pins.

14. The bowling game apparatus of claim 11, said pin toppling means comprises:

rise/lower members vertically shiftably embedded in said lane within areas on lane where said plurality of pins are placed, said rise/lower members including rise/lower member upper ends projecting upward from a surface of said lane when said rise/lower members have been shifted upward, and said rise/lower member upper ends being positioned slightly below a plane flush with the surface of said lane when said rise/lower members have been shifted downward; and a drive unit for shifting said rise/lower members up and down;

wherein said plurality of pins are toppled by said rise/lower members being shifted upward.

15. The bowling game apparatus of claim 14, further comprising a sound-effect generating means for outputting a sound effect mimicking the sound of pins colliding with each other and overturning;

wherein said second processing section of said control means is configured to actuate said sound-effect generating means to output the sound effect when said pin toppling means is actuated to topple said plurality of pins.

16. The bowling game apparatus of claim 11, wherein said pin toppling means comprises:

permanent magnets provided on undersides of said plurality of pins;

electromagnets embedded in, or arranged beneath, said lane within areas on said lane where said plurality of pins are placed; and an electric power supply device for supplying power to said electromagnets;

wherein polarities of mutually opposing sides of said permanent magnets and said electromagnets of the same polarity; and wherein said plurality of pins are toppled by supplying power to and thereby magnetizing said electromagnets.

17. The bowling game apparatus of claim 16, further comprising a sound-effect generating means for outputting a sound effect mimicking the sound of pins colliding with each other and overturning;

wherein said second processing section of said control means is configured to actuate said sound-effect generating means to output the sound effect when said pin toppling means is actuated to topple said plurality of pins.

18. The bowling game apparatus of claim 11, wherein said pin toppling means comprises vibration-generating mechanisms embedded in said lane within areas on said lane where said plurality of pins are placed;

wherein said plurality of pins are set onto said vibration-generating mechanisms, and said plurality of pins are toppled by vibration-generating mechanisms vibrating.

19. The bowling game apparatus of claim 18, further comprising a sound-effect generating means for outputting a sound effect mimicking the sound of pins colliding with each other and overturning;

wherein said second processing section of said control means is configured to actuate said sound-effect generating means to output the sound effect when said pin toppling means is actuated to topple said plurality of pins.

20. The bowling game apparatus of claim 11, further comprising a sound-effect generating means for outputting a sound effect mimicking the sound of pins colliding with each other and overturning;

wherein said second processing section of said control means is configured to actuate said sound-effect generating means to output the sound effect when said pin toppling means is actuated to topple said plurality of pins.

* * * * *